United States Patent [19]

Thomas

[11] 4,054,150

[45] Oct. 18, 1977

[54] APPARATUS FOR CLEANING A COOLING SYSTEM

[76] Inventor: Dalton A. Thomas, Alpine Rte. 1, Box 97, Winterboro, Ala. 35014

[21] Appl. No.: 709,934

[22] Filed: July 29, 1976

[51] Int. Cl.[2] ..... B08B 9/00

[52] U.S. Cl. ..... 134/169 A; 123/41.01

[58] Field of Search ..... 134/169 R, 169 A, 188, 134/193; 123/41.01

[56] References Cited

U.S. PATENT DOCUMENTS

| | | | |
|---|---|---|---|
| 1,969,815 | 8/1934 | Meyer | 123/41.01 |
| 2,380,604 | 7/1945 | Melton | 134/169 A X |
| 3,667,487 | 6/1972 | Schoenbeck et al. | 134/169 R X |
| 3,667,488 | 6/1972 | Paggen | 134/169 A |
| 3,780,757 | 12/1973 | Jordan | 134/169 R X |

*Primary Examiner*—Robert L. Bleutge
*Attorney, Agent, or Firm*—Woodford R. Thompson, Jr.

[57] ABSTRACT

Apparatus for cleaning a cooling system having inlet and outlet ports for circulating a cleaning fluid. A cleaning solution is supplied to one port of the cooling system with the other port thereof communicating with a discharge conduit. Positive pressure and a negative pressure are created alternately in the discharge conduit to cause the cleaning solution to flow in opposite directions. One check valve in the discharge conduit permits flow only in response to the creation of positive pressure and another check valve permits flow only in response to the creation of negative pressure. A member restrains opening of said one check valve until there is a predetermined increase in positive pressure and an other member restrains opening of the other check valve until there is a predetermined increase in negative pressure with said another member requiring a greater force to open said other check valve than the force required to open said one check valve whereby there is major flow toward discharge and minor flow in the reverse direction.

6 Claims, 5 Drawing Figures

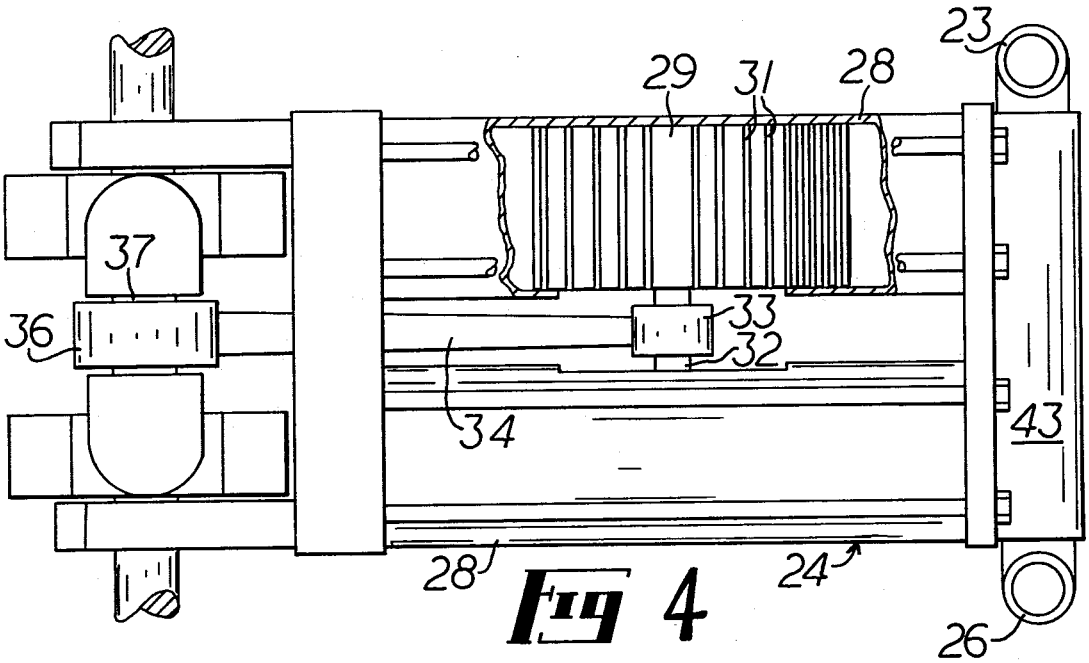
Fig 4
Fig 2
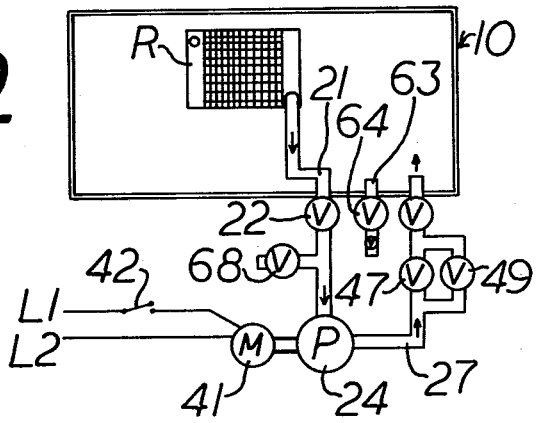
Fig 3
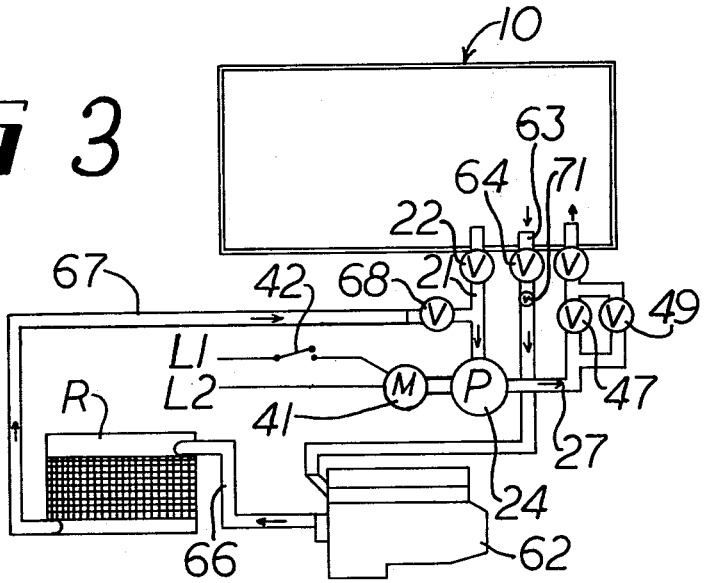

APPARATUS FOR CLEANING A COOLING SYSTEM

BACKGROUND OF THE INVENTION

This invention relates to apparatus for cleaning a cooling system and more particularly to apparatus for cleaning cooling systems or heat exchange units, such as radiators, the blocks of internal combustion engines, and the like.

Heretofore, in the art to which my invention relates, it has been the usual practice to clean radiators and the blocks of internal combustion engines by merely passing a continuous stream of water or other cleaning solution through the radiator or motor block whereby the system is flushed. In view of the fact that it is very difficult to dislodge scale and other particles deposited in such cooling system, conventional methods of flushing do not clean such systems adequately. While strong chemicals have been employed to partiallydissolve such deposits in cooling systems, it often occurs that the passageways through the cooling system, especially small passageways, are so plugged or stopped up by such deposits that the cleaning solution will not flow therethrough. Accordingly, the cleaning solution bypasses such areas whereby such areas cannot be cleaned.

SUMMARY OF THE INVENTION

In accordance with my present invention, I provide apparatus for cleaning a cooling system wherein a cleaning solution is supplied to one port of the cooling system, such as a radiator or motor block, with another port thereof communicating with a discharge conduit. I provide means for creating a positive pressure and a negative pressure alternately in the discharge conduit to cause the cleaning solution to flow in opposite directions. One check valve is provided in the discharge conduit which permits flow only in response to the creation of a positive pressure and another check valve is provided in the discharge conduit which permits flow only in response to creation of negative pressure in the discharge conduit. Means is provided for restraining opening of said one check valve until there is predetermined increase in positive pressure and other means is provided for restraining opening in the other check valve until there is a predetermined increase in negative pressure. The means restraining opening of the other check valve requires a greater force to open than the force required to open said one check valve whereby there is a major flow of the cleaning solution toward discharge and a minor flow of the cleaning solution in the reverse direction. Accordingly, there is a continuous agitation of the cleaning solution back and forth within the cooling system being cleaned with a major portion of the cleaning solution continuously moving toward discharge whereupon it is then returned to the supply of cleaning fluid. This back and forth agitation of the cleaning fluid through the system being cleaned unclogs all passageways, including small passageways, whereby the cleaning solution reaches all parts of the cooling system being cleaned.

Apparatus embodying features of my invention is illustrated in the accompaning drawings, forming a part of this application, in which:

FIG. 2 is a diagrammatic, top plan view of the apparatus shown in FIG. 1, drawn to a smaller scale with the cover for the storage chamber being removed;

FIG. 3 is a diagrammatic, top plan view corresponding to FIG. 2 but showing the apparatus being employed to clean a radiator and a motor block at the same time;

Figure 5:
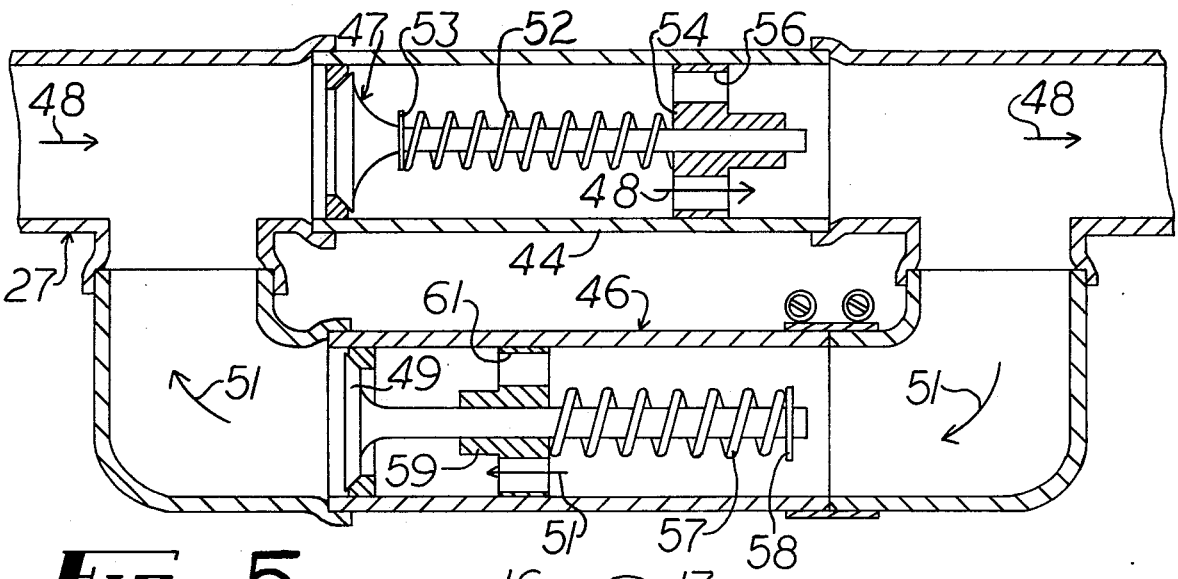

FIG. 4 is an enlarged, fragmental view, partly broken away, showing a means for creating alternately a positive pressure and a negative pressure in the discharge conduit; and, FIG. 5 is an enlarged, fragmental, sectional view showing the check valve arrangement in the discharge conduit, together with the means for restraining opening of the check valves whereby there is a major flow of cleaning solution toward discharge and a minor flow of the cleaning solution in a direction reverse to discharge flow.

DETAILED DESCRIPTION

Figure 1:
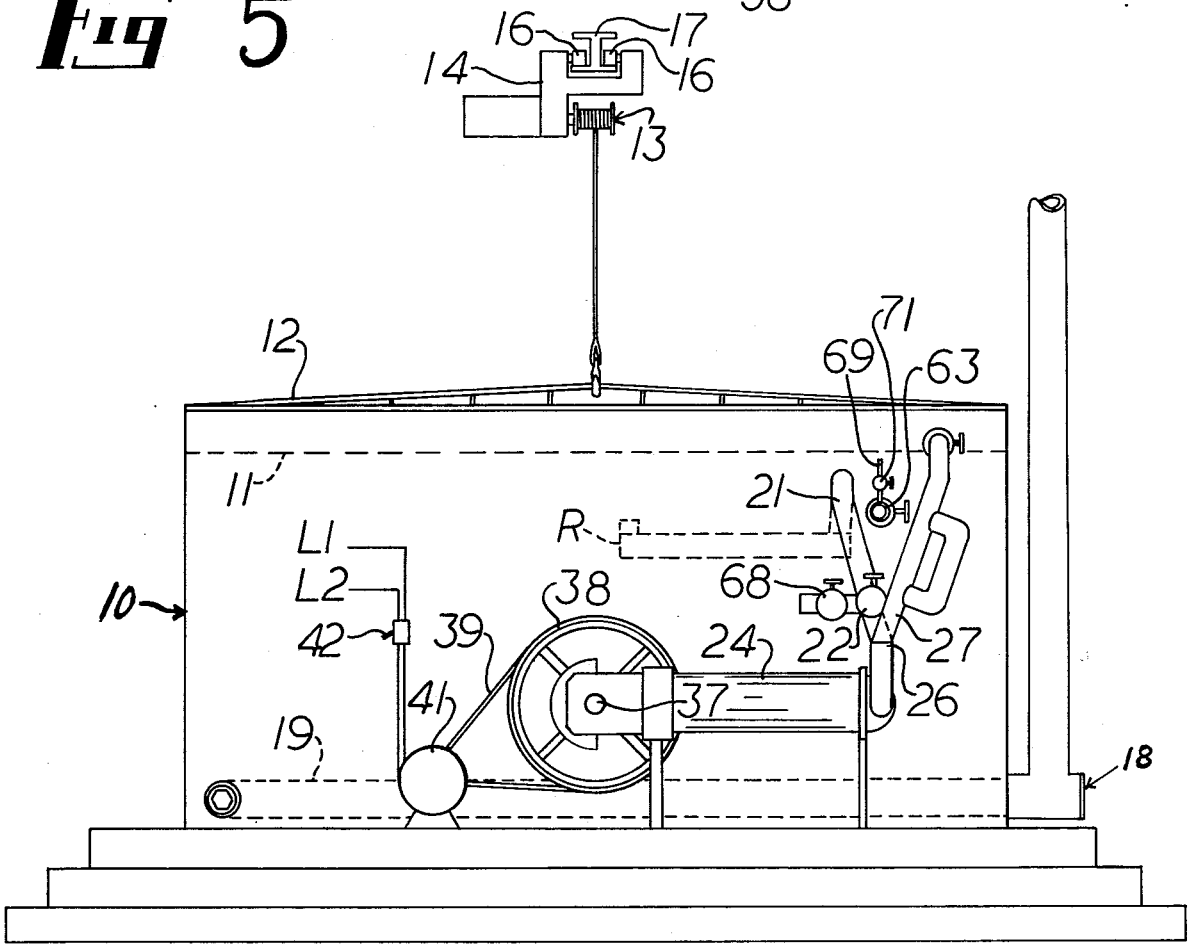
FIG. 1 is a side elevational view showing the apparatus cleaning a radiator removed from an internal combustion engine.

Referring now to the drawings for a better understanding of my invention, I show a storage chamber 10 for receiving a suitable cleaning solution, such as conventional type cleaning solutions for flushing radiators, motor blocks and the like. In view of the fact that such cleaning solutions are well known in the art to which my invention relates, no further description thereof is deemed necessary. The liquid level of the cleaning solution is indicated at 11. As shown in FIG. 1, the storage chamber 10 is covered by a suitable cover member 12 which may be rasided and lowered by a suitable lift device, such as a winch 13. The winch is shown as being mounted on a movable frame 14 having support rollers 16 which are adapted to ride along opposite sides of a guide beam 17. Accordingly, the cover 12 may be lifted by the winch 13 and then transferred laterally away from the storage chamber 10. Also, the winch 13 may be employed to lower a radiator R, or the like, into the storage chamber 10 for cleaning in a manner to be described hereinafter.

The cleaning solution in the storage compartment 10 may be heated by a suitable heat unit indicated generally at 18, which includes an elongated conduit 19 which extends inwardly of the storage chamber 10 adjacent the bottom thereof, as shown in FIG. 1. In view of the fact that various forms of heating means may be employed for heating the contents of the storage chamber 10, no further description thereof is deemed necessary.

To clean a radiator R, or the like, within the storage chamber 10, one port of the radiator R is connected to the receiving end of a discharge conduit 21 having a control valve 22 therein. As shown in FIGS. 2 and 4, the conduit 21 communicates with the intake 23 of a reciprocating pump unit indicated generally at 24. The outlet 26 of the pump unit 24 communicates with a discharge conduit 27.

The reciprocating pump unit 24 is shown as comprising a pair of parallel cylinders 28 having pistons 29 mounted for reciprocation therein, as shown in FIG. 4. Each piston 29 is provided with suitable sealing rings 31 to provide a fluid-tight seal between the outer surface of the piston and the inner surface of the cylinder 28. Each piston 29 is connected to a shaft 32 which in run is connected to a bearing member 33 carried by the adjacent end of a rocker arm 34. The other end of the rocker arm 34 carries a bearing member 36 which is operatively connected to a crank shaft 37 which carries a ɔulley 38 which is operatively connected by a drive belt 39 to a motor unit 41. Accordingly, as the crank shaft 37 s rotated the shaft 32 and the pistons 29 connected hereto are reciprocated back and forth to create alternately a positive and a negative pressure in the discharge conduit 27. Power is supplied to the motor 41 hrough suitable leads $L^1$ and $L^2$, with the source of ɔower being controlled by a suitable switch 42. As hown in FIG. 4, the ends of the cylinders 28 communicate with a common chamber 43 which is provided with he inlet port 23 and outlet port 26. Accordingly, as the ɔistons 29 are recpirocated in a direction to create a ɔositive pressure in conduit 27 a positive pressure is also reated in conduit 21. In like manner, as a negative ɔressure is created in conduit 27 a negative pressure is lso created in conduit 21.

As shown in FIG. 5, the discharge conduit 28 is divided intermediate its ends to provide separate conduit ections 44 and 46. The conduit section 44 is provided vith a check valve 47 therein which permits flow only n responseto the creation of positive pressure in the ischarge conduit 27 so that the flow of liquid is toward ischarge, as indicated by the arrows shown in FIG. 2 nd the arrows 48 shown in FIG. 5. Mounted in the onduit section 46 is a check valve 49 which permits low only in response to the creation of negative pressure in the discharge conduit 27, as indicated by arrows 1, so that flow of fluid is reversed to discharge flow.

The check valve 47 is urged to the left, as viewed in IG. 5, toward closed position by a compression spring 2 which engages a spring abutment 53 carried by the heck valve 47 and a spring abutment 54 mounted vithin the conduit section 44. Suitable passageways 56 re provided through the spring abutment member 54 ɔr the passage of fluid toward discharge.

The check valve 49 is urged toward the right, as iewed in FIG. 5, toward closed position by a spring ıember 57 which engages a spring abutment 58 carried y the check valve 49 and a spring abutment member 59 ıounted within the conduit section 46. Suitable passageways 61 are provided through the spring abutment ıember 59 for the passage of fluid in a reverse direction ı discharge flow, as indicated by the arrow 51.

From the foregoing, it will be seen that the spring ember 52 restrains opening of the check valve 47 until ıere is a predetermined increase in positive pressure ıward discharge, as indicated by the arrows in FIG. 2 ıd the arrows 48 in FIG. 5. The spring member 57 strains opening of the check valve 49 until there is a edetermined increase in negative pressure in the disıarge conduit 27 with the spring member 57, which strains opening of check valve 49, requiring a greater rce to open than the force required to open check ılve 47. That is, the spring member 57 is stronger than e spring member 52 whereby a greater force is retired to unseat the check valve 49. Accordingly, there a major flow of cleaning solution toward discharge, as dicated by arrows in FIG. 2 and the arrows 48 in FIG. and a minor flow of cleaning solution in a direction verse to discharge flow, as indicated by the arrows 51.

From the foregoing description, the operation of my ıproved apparatus for cleaning a cooling system will readily understood. To clean a radiator R after it has en removed from a vehicle or other supporting frame, e radiator R is placed in the storage chamber 10, as own in FIGS. 1 and 2, and the receiving end of conit 21 is connected to one port of the radiator. The lve 22 is opened whereby the cleaning solution flows by gravity to the pump unit 24 whereupon it is then conveyed to the discharge conduit 27. The pump unit 24 creates alternately a positive pressure and a negative pressure in the discharge conduits 27 21 and, as described hereinabove. The check valve 47 permits flow only in response to the creation of positive pressure in the discharge conduit 27 whereby flow is toward discharge, as indicated by the arrows 48. The other check valve 49 permits flow only in response to the creation of negative pressure in the discharge conduit 27 whereby flow is then in a reverse direction to discharge flow, as indicated by the arrows 51. This negative pressure or partial vacuum in the discharge conduits 21 and 27 causes any deposits or the like which clog the cooling system to become dislodged or break down whereby they are then removed with the moving cleaning solution. The spring member 52 restrains opening of the check valve 47 until there is a predetermined increase in positive pressure toward discharge while the spring member 57 restrains opening of the other check valve 49 until there is a predetermined increase in negative pressure in the discharge conduit 27. The spring member 57 is stronger than the spring member 52 whereby a greater force is required to open the check valve 49 than the force required to open the check valve 47. Accordingly, there is a major flow of cleaning solution through the inlet and outlet of pump 24 toward discharge as indicated by arrows in FIG. 2 and a minor flow of cleaning solution in a direction reverse to discharge flow. Accordingly, the overall intermittent flow of the cooling solution is toward discharge, as shown by the arrows in FIG. 2, whereby port 23 is considered an inlet port and port 26 is considered an outlet port for pump 24. This back and forth movement of the cleaning solution agitates the cleaning solution throughout the cooling system being cleaned whereby areas that are stopped with deposits or the like are unclogged, thus permitting free passageway of the cleaning solution through all parts of the system being cleaned. The liquid level 11 is maintained at an elevation to keep the system primed with liquid during operation. After cleaning, the radiator R is disconnected from the conduit 21 and is removed from the storage chamber 10 whereupon it is flushed in the usual manner to remove cleaning solution.

Where it is desired to clean the radiator R while it is installed in a vehicle or other frame, along with the motor block, indicated at 62, the valve 22 is closed. A receiving conduit 63 having a control valve 64 therein is connected to the upper port of the cooling system for the block 62 while the lower port of the block 62 is connected by a conduit 66 to the top of the radiator R. The bottom port of the radiator R is then connected by a conduit 67 to the conduit 21 described hereinabove. The conduit 67 has a control valve 68 therein, as shown in FIG. 3. It will be noted that the control valve 68 is closed while the apparatus is being employed to clean a radiator R in the storage chamber 10, as shown in FIG. 2.

With the system thus connected to the motor block 62 and radiator R, as shown in FIG. 3, the valve 64 is opened while the valve 22 is closed. Cleaning solution is then drawn into the conduit 63 whereupon it flows through the motor block 62, conduit 66, radiator R and then through conduit 67 to conduit 21. The cleaning solution is then drawn into the pump unit 24 whereupon it is discharged into the discharge conduit 27 described hereinabove having the check valve 47 and 49 therein.

The pump unit creates alternately a positive pressure and a negative pressure in the discharge conduits 21, 67 and 27 whereby the cleaning solution is agitated throughout the apparatus, including the passageways through the motor block 62 and the radiator R. Since the check valve 49 requires a greater force to open the same than the check valve 47, there will be a major flow of cleaning solution toward discharge into the supply chamber 10 whereupon the cleaning solution is recirculated. At the same time there will be a minor flow of cleaning solution in a reverse direction to thus produce a back and forth agitation of the cleaning solution through the motor block 62 and the radiator R.

After the radiator R and motor block 62 have been cleaned, the valve 64 is closed. Air under pressure is then introduced into the conduit 63 through an air supply conduit 69 having a control valve 71 therein. The air under pressure then forces the cleaning solution through conduit 63, motor block 62, conduit 66, radiator R, conduit 67, conduit 21 and then through the pump unit 24 whereupon it is forced through discharge conduit 27 back to the supply chamber 10. After removing the cleaning solution by air, the motor block 62 and radiator R may be flushed in the usual manner to remove any residual cleaning solution left in the systems.

While I have shown in FIG. 3 of the drawings the apparatus as being used to clean a radiator R and a motor block 62 in series, it will be apparent that the system could be employed to clean either the radiator R or the motor block 62 separately while either is installed in a vehicle or other supporting frame.

From the foregoing, it will be seen that I have devised improved apparatus for cleaning a cooling system. By providing a closed circuit system for circulating the cleaning solution through the cooling system being cleaned, there is a minimum loss of cleaning solution. Also, by creating alternately a positive pressure and a negative pressure in the discharge conduits which results in back and forth agitation of the cleaning solution in the system being cleaned, I greatly increase the efficiency of the apparatus and at the same time permit cloged areas to be easily unclogged whereby the cleaning solution is free to enter all passageways throughout the cooling system. Furthermore, by providing means for cleaning separately or together a motor block and a radiator, my improved apparatus is adapted to be transported to the location of the motor block and/or radiator whereby it is not necessary to remove the radiator or motor block from its supporting frame, thus permitting my improved apparatus to be particularly adapted for cleaning cooling systems having relatively large motor blocks and radiators.

While I have shown my invention in but two forms, it will be obvious to those skilled in the art that it is not so limited, but is susceptible of various other changes and modifications without departing from the spirit thereof.

What I claim is:

1. Apparatus for cleaning a cooling system having a port for receiving a cooling solution and a port for discharging said cooling solution, a. means supplying a cleaning solution, b. means communicating one said port of said cooling system with said means supplying a cleaning solution, c. a first discharge conduit communicating with the other said port of said cooling system, d. pump means communicating with said first discharge conduit and a second discharge conduit and creating alternately a positive pressure and a negative pressure in said discharge conduits, e. flow control means permitting flow of cleaning solution toward discharge through said second discharge conduit in response to the creation of positive pressure in said second discharge conduit and permitting flow of cleaning solution through said second discharge conduit in a direction reverse to discharge flow in response to the creation of negative pressure in said second discharge conduit, f. means restraining said flow in said second discharge conduit toward discharge until there is a predetermined increase in positive pressure in said second discharge conduit, and g. means restraining said flow in said second discharge conduit in a direction reverse to discharge flow until there is a predetermined increase in negative pressure in said second discharge conduit with the means restraining said flow in a direction reverse to discharge flow requiring a greater pressure to permit flow than the pressure required to permit flow toward discharge so that there is a major flow of cleaning solution toward discharge and a minor flow of cleaning solution in a direction reverse to discharge flow.

2. Apparatus for cleaning a cooling system as defined in claim 1 in which said means creating alternately a positive pressure and a negative pressure in said discharge conduits comprises a reciprocating pump communicating with said discharge conduits and having at least one cylinder with a piston mounted for reciprocation therein.

3. Apparatus for cleaning a cooling system as defined in claim 2 in which said reciprocating pump comprises a pair of parallel cylinders having pistons mounted for reciprocation therein.

4. Apparatus for cleaning a cooling system as defined in claim 1 in which said means supplying a cleaning solution comprises a storage chamber with the liquid level of said cleaning solution in said chamber being above said means creating alternately a positive pressure and a negative pressure in said discharge conduits.

5. Apparatus for cleaning a cooling system as defined in claim 1 in which said flow control means comprises a pair of check valves in communication with said second discharge conduit with one said check valve permitting flow of cleaning solution toward discharge and the other check valve permitting flow of cleaning fluid in a direction reverse to discharge flow.

6. Apparatus for a cooling system as defined in claim 5 in which said means restraining opening of said one check valve and said other check valve comprises spring elements urging said one check valve and said other check valve toward closed position.

* * * * *